US005708756A

United States Patent [19]

Wang et al.

[11] Patent Number: 5,708,756

[45] Date of Patent: Jan. 13, 1998

[54] LOW DELAY, MIDDLE BIT RATE SPEECH CODER

[75] Inventors: Jeng-Yih Wang, Taipei; Chau-Kai Hsieh, Hsinchu, both of Taiwan

[73] Assignee: Industrial Technology Research Institute, Hsinchu, Taiwan

[21] Appl. No.: 394,332

[22] Filed: Feb. 24, 1995

[51] Int. Cl.[6] ..... G10L 3/02

[52] U.S. Cl. ..... 395/2.29; 395/2.28

[58] Field of Search ..... 395/2, 2.1, 2.25–2.32; 381/36–40

[56] References Cited

U.S. PATENT DOCUMENTS

| | | | |
|---|---|---|---|
| 4,868,867 | 9/1989 | Davidson et al. | 381/36 |
| 4,896,361 | 1/1990 | Gerson | 395/2.31 |
| 5,142,583 | 8/1992 | Galand et al. | 381/38 |
| 5,233,660 | 8/1993 | Chen | 395/2.31 |
| 5,327,520 | 7/1994 | Chen | 395/2.28 |
| 5,434,947 | 7/1995 | Gerson et al. | 395/2.28 |

OTHER PUBLICATIONS

J.-H. Chen et al., "A Low-Delay CELP Coder for the CCITT 16 kb/s Speech Coding Standard," IEEE Journal on Selected Areas in Communications, 10(5):830–849, Jun. 1992, Jun. 1992.

J.R. Deller et al., "Discrete-Time Processing of Speech Signals," 1987, pp. 290–292, 297–302, 473–474.

T. Parsons, "Voice and Speech Processing," 1987, pp. 267–269, 373–374.

*Primary Examiner*—Allen R. MacDonald
*Assistant Examiner*—Michael N. Opsasnick
*Attorney, Agent, or Firm*—Meltzer, Lippe, Goldstein, Wolf & Schlissel, P.C.

[57] ABSTRACT

A digital speech encoder and decoder have particular application to the field of 16 kbps digital communications. In the encoder, a speech signal is processed by a perceptual weighting filter, using a reconstructed speech signal, a reconstructed residual signal, and a set of filter tuning coefficients. A predictive signal, which is generated by a Short Term Predictive (STP) circuit, is subtracted from the signal outputted from the perceptual weighting filter. The difference signal is processed by a coder/decoder circuit to produce a reconstructed error signal, which is added to the predictive signal to form the reconstructed residual signal. A Linear Predictive Coding (LPC) circuit receives the reconstructed residual signal and develops the set of filter tuning coefficients. The set of filter tuning coefficients are outputted to the STP circuit, which also receives the reconstructed residual signal, and thereby generates the predictive signal. The set of filter tuning coefficients are also outputted to the perceptual weighting filter, and to a complementary inverse perceptual weighting filter. The inverse perceptual weighting filter also receives the reconstructed residual signal, in accordance with the set of filter tuning coefficients. The decoder includes identical STP, LPC, and inverse perceptual weighting filter circuits for reconstructing the received signals from the encoder.

18 Claims, 4 Drawing Sheets

LOW DELAY, MIDDLE BIT RATE SPEECH CODER

FIELD OF THE INVENTION

The present invention relates to a digital speech encoder and decoder with particular application to low delay voice communication systems.

BACKGROUND OF THE INVENTION

Current techniques of digital speech coding include Vector Quantization (VQ) combined with Linear Predictive Coding (LPC) to achieve low time delays in the coding process, while maintaining acceptable levels of phonetic quality at bit rates such as 16 kbps. The CCITT G.728 specification for a low delay 16 kbps speech coder, for example, indicates a theoretical delay of 0.625 ms. The complexity of the G.728 coding procedure, however, requires extensive calculations and leads to high manufacturing costs, which may be unacceptable for commercial applications.

FIG. 1 shows a prior art disclosed in U.S. Pat. No. 5,142,583, entitled "Low-Delay Low-Bit-Rate Speech Coder" (Galand). The input signal flow of samples s(n) is first segmented and buffered in device 25 into 1 ms blocks (8 samples/block). Signal s(n) is then decorrelated by a Short Term Predictive (STP) filter 10, which is adapted every 1 ms by a tuning coefficient $a_i$, to be described later. The STP filter 10 converts each 8-samples long block of s(n) signal into a residual excitation signal r(n). The r(n) signal is converted to an error residual signal e(n) by subtracting therefrom in summing circuit 12 a predictive residual signal x(n), to be referred to later. Error signal e(n) is encoded by Pulse Exciter 16, and then quantized by Vector Quantizer 20. The Quantizer 20 outputs (X, L, C) are decoded by decoder 22 to produce an output signal p'(n). Signal p'(n) is added to predictive residual signal x(n) in summing circuit 13 to form a reconstructed residual signal r'(n). In one of two branches, signal r'(n) is filtered by smoothing filter 15 to form a smoothed reconstructed residual signal r"(n). Signal r"(n) is filtered by a Long Term Predictive (LTP) filter 14, to produce the aforementioned predictive residual signal x(n). Signal r"(n) is also inputted to a Long Term Predictive Adaptive (LTP Adapt) filter 31, which derives the LTP parameters (b, M) every millisecond.

In the other branch of signal r'(n), the signal r'(n) is filtered through a weighted vocal tract synthesis filter (or inverse filter) 29 to produce a reconstructed speech signal s'(n). Signal s'(n) is a set of 8 samples, which is analyzed in a Short Term Predictive Adaptive (STP Adapt) circuit 27 to produce the aforementioned filter tuning coefficient $a_i$ (i=0, . . . , 8). Tuning coefficient $a_i$ is inputted to STP filter 10 and inverse filter 29 to provide time variant adapting.

The above described prior art system requires a processing delay in excess of 1 ms, since it includes a 1 ms sampling time in addition to any coding/quantizing delays. It should also be noted that only one prediction model is used in this design; namely, the predictive residual signal x(n), which is generated by LTP filter 14, using backward pitch prediction parameters based on previous input signals. As described above, signal x(n) is subtracted from residual excitation signal r(n) to form error residual signal e(n), prior to quantizing.

Another speech encoder shown in FIG. 2 is described in R.O.C. patent application serial no. 83103339, entitled "Low-Delay Low-Complexity Speech Coder". As shown in FIG. 2, with switches S1 closed and S2 open, a zero-input response signal S'(n) from filter $W^{-1}(z)$ 2110 is subtracted from an input signal S(n) in summing circuit 2200 to form a difference signal Sp(n). Signal Sp(n) is then compressed by a perceptual weighting filter W(z) 2300 to produce a residual signal r(n). Filter W(z) 2300 is adapted by a tuning coefficient $a_i$, to be described later.

A predictive residual signal X(n) is subtracted from signal r(n) in summing circuit 2410 to produce an error residual signal e(n). Signal e(n) is quantized by Vector Quantizer 2420 (within quantizer/codebook assembly 242) to produce a gain output g and a codebook index output k. Gain signal g is combined with codebook 2421 residue vector $\overline{V}_k$ (a set of signal samples corresponding to index k) in multiplier 2422 to produce a reconstructed error residual signal e'(n). Signal e'(n) is added to the predictive signal X(n) in summing circuit 2423 to produce reconstructed residual r'(n). Signal r'(n) is split into four branches, wherein it is inputted to LTP filter 2401, Linear Predictive Coding (LPC) analysis circuit 2500, LTP analysis circuit 2400, and inverse weighting filter W'(z) 2110. LTP analysis circuit 2400 also receives residual signal r(n) and generates LTP parameters (b, M) to LTP filter 2401. Filter 2401 generates the aforementioned predictive signal X(n), using forward pitch prediction, which is inputted to summing circuits 2410 and 2423. The LPC analysis circuit 2500 generates the aforementioned tuning coefficient $a_i$, based on an analysis of reconstructed residual signal r'(n).

The forward prediction technique used in LTP filter 2401 is based on prediction parameters derived from the actual input signal. This technique results in a minimum delay of at least 5 ms for the speech coder.

It is an object of the present invention to reduce the delay of a digital speech coder to less than 1 ms. It is a further object of the present invention to minimize the complexity of the coding process in order to achieve economies of manufacture for commercial low and middle bit rate speech coders (e.g., 16 kbps). It is yet a further object of the present invention to maintain a high degree of phonetic quality in this category of speech coders.

SUMMARY OF THE INVENTION

The above described objects are achieved by the present invention, which provides both a speech encoder and a corresponding speech decoder.

According to one embodiment, an inventive speech encoder is provided with a perceptual weighting filter W(z) which converts an input signal S(n) to a residual signal r(n), using a reconstructed speech signal S'(n), a reconstructed residual signal r'(n), and a set of filter tuning coefficients $a_i$. A predictive residual signal X(n) is subtracted from the residual signal r(n) to produce an error residual signal e(n). A coding/decoding circuit processes error residual signal e(n) and outputs a reconstructed error residual signal e'(n), in addition to outputting a gain signal parameter c and a codebook index signal k to, for example, a remote decoder. The reconstructed error residual signal e'(n) is added to the predictive residual signal X(n) to form a reconstructed residual signal r'(n). A Linear Predictive Coding (LPC) circuit receives the reconstructed residual signal r'(n) and applies a linear analysis technique to generate the set of filter tuning coefficients $a_i$, which represents a time variant transfer function of a vocal tract model. A Short Term Predictive (STP) circuit also receives the reconstructed residual signal r'(n), as well as the set of filter tuning coefficients $a_i$, and outputs the predictive residual (vocal tract model) signal X(n).

Illustratively, an inverse perceptual weighting filter $W^{-1}(z)$ is provided which also receives signal r'(n) and set of filter tuning coefficients $a_i$, and outputs the synthesized reconstructed speech signal S'(n).

According to another embodiment, an inventive speech decoder is provided with an LPC circuit which receives a reconstructed residual signal r'(n), and outputs a set of filter tuning coefficients $a_i$. (Illustratively, a decoder circuit is provided which receives the gain parameter c and codebook index signal k from the above described encoder and outputs the reconstructed error residual signal e'(n). Signal e'(n) is added to a predictive residual signal X(n) to form the reconstructed residual signal r'(n).) An STP circuit also receives the reconstructed residual signal r'(n), in addition to the set of filter tuning coefficients $a_i$, and outputs the predictive residual signal X(n). An inverse perceptual weighting filter $W^{-1}(z)$ receives signal r'(n) and the set of filter tuning coefficients $a_i$, and synthesizes a reconstructed speech signal S'(n), which is outputted from the decoder.

The above described inventive speech encoder enhances the phonetic quality of the speech signal by compressing it in the perceptual weighting filter W(z) prior to the quantization process, and then restoring the reconstructed signal through the inverse perceptual weighting filter $W^{-1}(z)$.

Further, the inventive speech encoder achieves a minimum delay of less than 1 ms through the use of a backward (based on past measurements) zero-input short term predictor (STP) circuit.

The present invention will be more clearly understood from the following description of a preferred embodiment thereof, when taken in conjunction with the accompanying drawings.

DETAILED DESCRIPTION OF THE INVENTION

Figure 3:
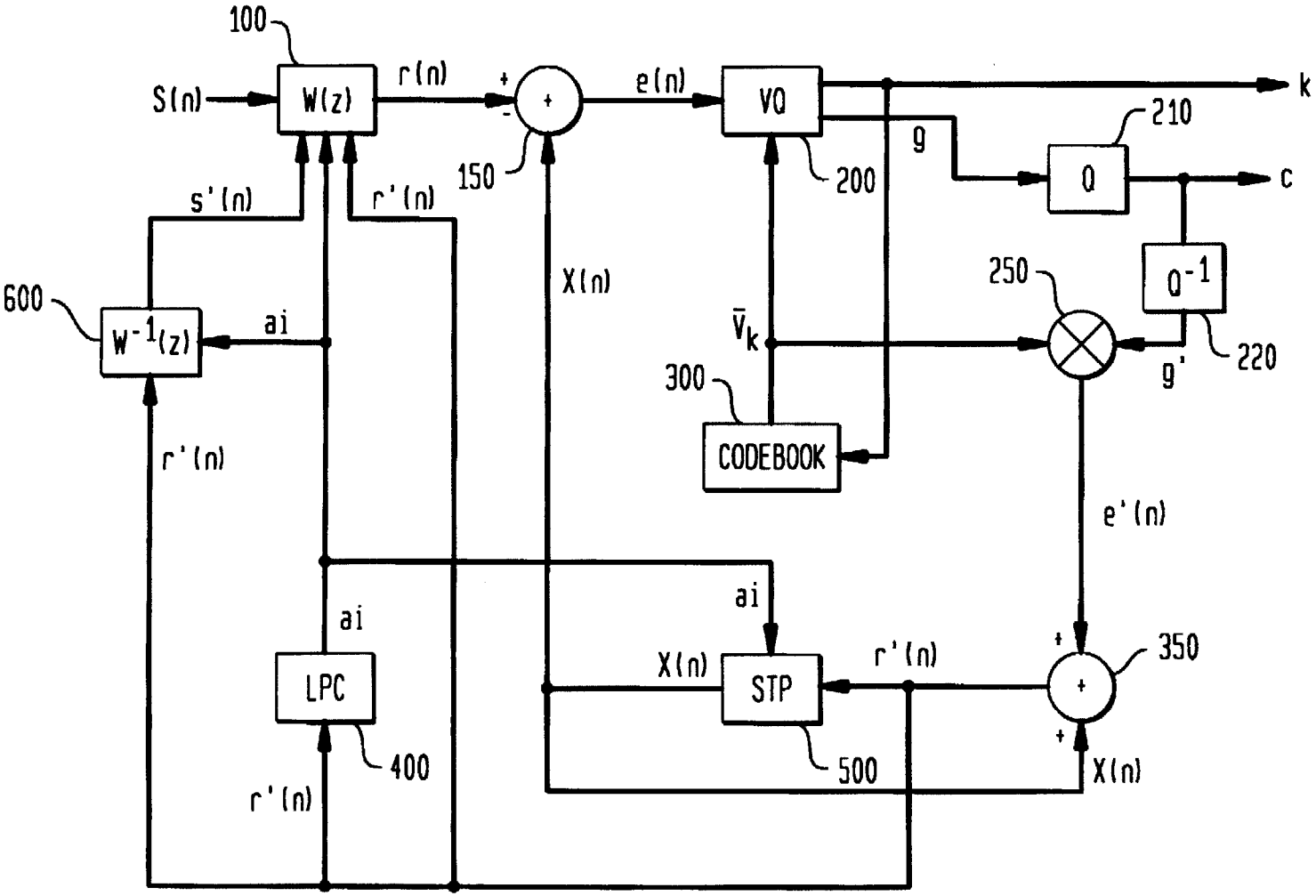
FIG. 3 illustrates the inventive speech encoder.

According to one embodiment, the inventive encoder disclosed herein is shown in block form in FIG. 3. Speech signal S(n) is filtered by a perceptual weighting filter W(z) 100, which is dynamically adapted by a set of filter tuning coefficients $a_i$. The frequency response of filter W(z) 100 provides an auditory compensating effect, to optimize the phonetic quality and efficiency of the coding process.

A residual signal r(n) is generated from filter W(z) 100, according to the following equation:

$$r(n) = S(n) - \sum_{i=1,n-i\geq 0}^{10} a_i\alpha^i S(n-i) - \sum_{i=1,n-i<0}^{10} a_i\alpha^i S'(n-i) + \sum_{i=1,n-i\geq 0}^{10} a_i\gamma^i r(n-i) + \sum_{i=1,n-i<0}^{10} a_i\gamma^i r'(n-i) \quad (1)$$

where $\alpha=0.9$, $\gamma=0.6$

A predictive residual signal X(n) is subtracted from residual signal r(n) in summing circuit 150 to produce an error residual signal e(n). The generation of the predictive residual signal X(n) is discussed below. Error residual signal e(n) is processed by a shape/gain Vector Quantizer 200. VQ 200 searches a codebook 300 for a shape vector $\overline{V}_k$ (a block of signal samples stored in codebook 300 corresponding to a codebook index k) and a gain factor g, such that the product of g and $\overline{V}_k$ most closely matches error residual signal e(n). That is, suppose the vector $\overline{E}$ is composed of m error residues e(n), e(n+1), . . . , e(n+m−1). $\overline{E}$ can be represented as the product $g.\overline{V}_k$ where $\overline{V}_k$ is a $k^{th}$ unit-norm shape vector and g is a scaling constant. To determine k, the codebook 300 is searched over all I vectors $\overline{V}_i$ for i=1 to I in the codebook 300 for the index i which maximizes:

$$\frac{|\vec{E}\cdot\vec{V}_i|}{|\vec{V}_i|} \quad (2)$$

where "." represents the "scalar" or dot product of two vectors and "$|\overline{Z}|$" represents the absolute value of $\overline{Z}$ (the square root of the sum of the squares of each component of $\overline{Z}$). Then k is the value of i which maximizes equation (2). Knowing k, and therefore, $\overline{V}_k$, the gain g is determined from:

$$g = \frac{\vec{E}\cdot\vec{V}_k}{|V_k|^2} \quad (3)$$

This equals $\overline{E}.\overline{V}_k$ because $|\overline{V}_k|=1$.

Vector Quantizer 200 outputs codebook index k to a remote decoder and gain factor g to a Scalar Quantizer 210. The Scalar Quantizer 210 quantizes g to a parameter c and outputs c to a Scalar Dequantizer 220 and also to the remote decoder. Scalar Quantizer circuit 220 restores the dequantized gain factor g' and outputs it to a multiplier 250.

Shape vector $\overline{V}_k$ is outputted from codebook 300 to multiplier 250, where it is multiplied by gain factor g' to produce a reconstructed error residual signal e'(n). Predictive residual signal X(n) is added to error signal e'(n) in summing circuit 350 to form a reconstructed residual signal r'(n).

Reconstructed residual signal r'(n) is backward analyzed by a Linear Predictive Coding (LPC) circuit 400 to produce the set of adaptive filter tuning coefficients $a_i$. LPC circuit 400 uses a window of length 120, i.e., including the immediately preceding 120 reconstructed residues at intervals n=−120 to n=−1, to derive an autocorrelation function R(k), where k=0 to 10. The autocorrelation function R(k) is derived according to the following equation:

$$R(k) = \sum_{n=-120}^{-1-k} r'(n) f_w(-n)\, r'(n+k) f_w(-n-k) \quad (4)$$

where $f_w(.)$ is the window function.

Durbin's method is then used to derive the set of filter tuning coefficients $a_i$, where i=1 to 10 as follows:

$$E^{(0)} = R(0), \quad (5)$$

$$k_i = \frac{\left\{ R(i) - \sum_{j=1}^{i-1} a_j^{(i-1)} R(i-j) \right\}}{E^{(i-1)}}$$

$$a_i^{(i)} = k_i$$

$$a_j^{(i)} = a_j^{(i-1)} - k_i a_{i-j}^{(i-1)},$$

$$E^{(i)} = (1 - k_i^2)\, E^{(i-1)}$$

A Short Term Predictive (STP) all-pole predictor circuit 500 receives the reconstructed residual signal r'(n) and the set of filter tuning coefficients $a_i$, and uses backward zero-input short term prediction, based on the following equation, to develop the predictive residual signal X(n):

$$X(n)=\sum_{i=1}^{10} a_i X(n-i) \quad (6)$$

where $X(n)=r'(n)$ for $-10 \leqq n \leqq -1$

An inverse perceptual weighting filter $W^{-1}(z)$ 600, having the inverse function of filter W(z) 100, receives the reconstructed residual signal r'(n) and the set of filter tuning coefficients $a_i$, and reconstructs the synthesis speech signal S'(n), which is outputted to filtering circuit W(z) 100.

Figure 4:
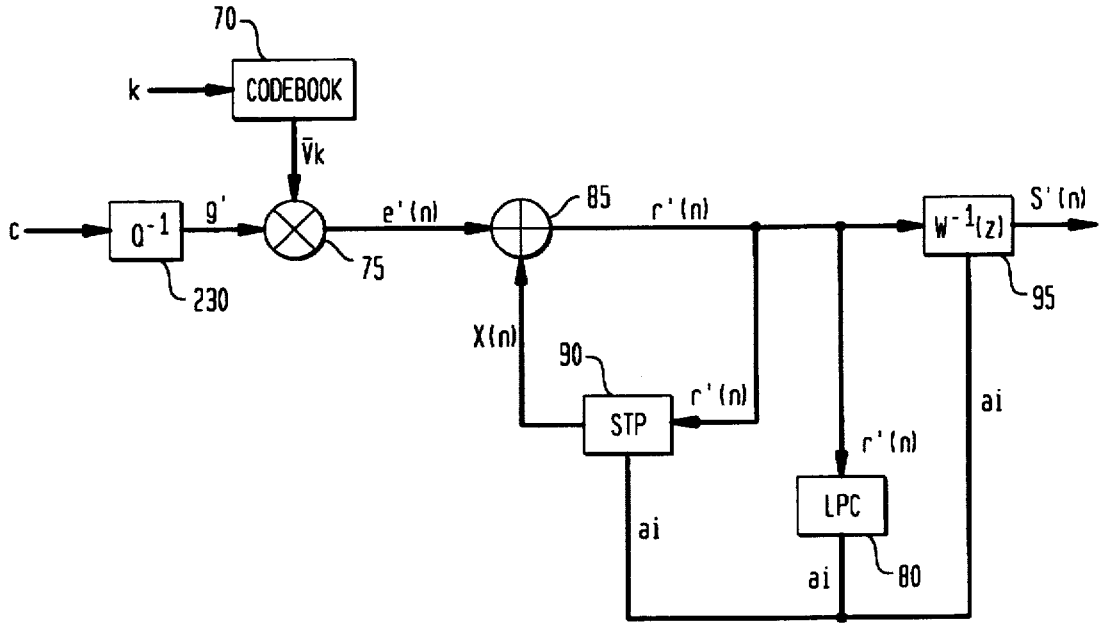
FIG. 4 illustrates the inventive speech decoder.

A block diagram of the inventive decoder is depicted in FIG. 4. The encoder codebook index signal k is inputted to an identical decoder codebook 70, causing it to output the corresponding shape vector $\overline{V}_k$. The gain parameter c is inputted to identical Dequantizer circuit 230, causing it to output the dequantized gain factor g'. The gain factor encoder is multiplied with vector $\overline{V}_k$ in multiplier 75 to produce a reconstructed error residual signal e'(n). A predictive residual signal X(n) is added to reconstructed error residual signal e'(n) in summing circuit 85 to produce a reconstructed residual signal r'(n). As in the inventive encoder of FIG. 3, LPC circuit 80 (FIG. 4) receives reconstructed residual signal r'(n) and outputs a set of filter tuning coefficients $a_i$. Again, as in the encoder of FIG. 3, STP circuit 90 (FIG. 4) receives the set of filter tuning coefficients $a_i$ from LPC circuit 80, and reconstructed residual signal r'(n), and outputs predictive residual signal X(n) to summing circuit 85. Finally, inverse perceptual filter $W^{-1}(z)$ 95 receives reconstructed residual signal r'(n) and set of filter tuning coefficients $a_i$, and outputs reconstructed speech signal S'(n), as in the encoder of FIG. 3.

Figure 1:
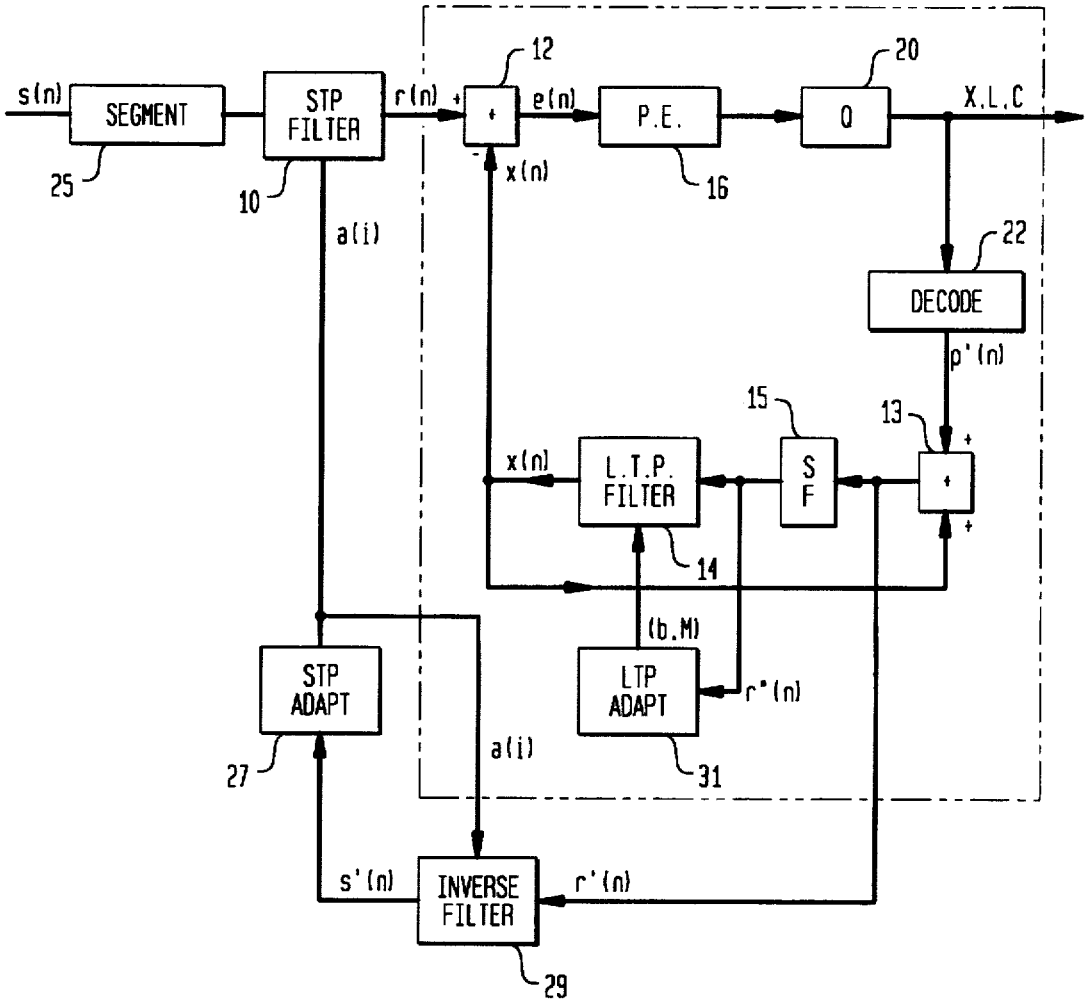
FIG. 1 (PRIOR ART)
FIG. 1 illustrates a prior art speech encoder.

In summary, the important differentiating features of the above described embodiment of the present invention will be noted below, to distinguish the present invention from the speech coders of FIGS. 1 and 2.

(1) Prior art U.S. Pat. No. 5,142,583 vs. present invention:

(a) The signal used for LPC analysis in U.S. Pat. No. 5,142,583 is the reconstructed speech signal S'(n), whereas the signal used for LPC analysis in the present invention is the reconstructed residual signal r'(n).

(b) The method of quantization in U.S. Pat. No. 5,142,583 is pulse-excited quantization, whereas the present invention uses shape/gain quantization.

(c) The prediction technique used in U.S. Pat. No. 5,142,583 is backward pitch prediction for predictive signal X(n), whereas the present invention uses backward zero-input short-term prediction for predictive signal X(n).

(d) The residual signal r(n) is derived in U.S. Pat. No. 5,142,583 from the following equation:

$$r(n)=S(n)-\sum_{i=1}^{8} a_i S(n-i)+\sum_{i=1}^{8} c_i r(n-i) \quad (7)$$

where
$c_i=a_i\, g^i$,
n=1 to 8,
$g^i=0.8$ whereas the residual signal r(n) in the present invention is derived from Equation (1), as follows:

$$r(n)=S(n)-\sum_{i=1,n-i\geqq 0}^{10} a_i\alpha^i S(n-i)-\sum_{i=1,n-i<0}^{10} a_i\alpha^i S'(n-i)+ \quad (1)$$

-continued $$\sum_{i=1,n-i\geqq 0}^{10} a_i\gamma^i r(n-i)+\sum_{i=1,n-i<0}^{10} a_i\gamma^i r'(n-i)$$

where
$\alpha=0.9$
$\gamma=0.6$ (e) In the prior art U.S. Pat. No. 5,142,583, the minimum delay is greater than 1 ms for a 16 kbps bit rate, whereas in the present invention, the minimum delay can be less than 1 ms for a 16 kbps bit rate.

Figure 2:
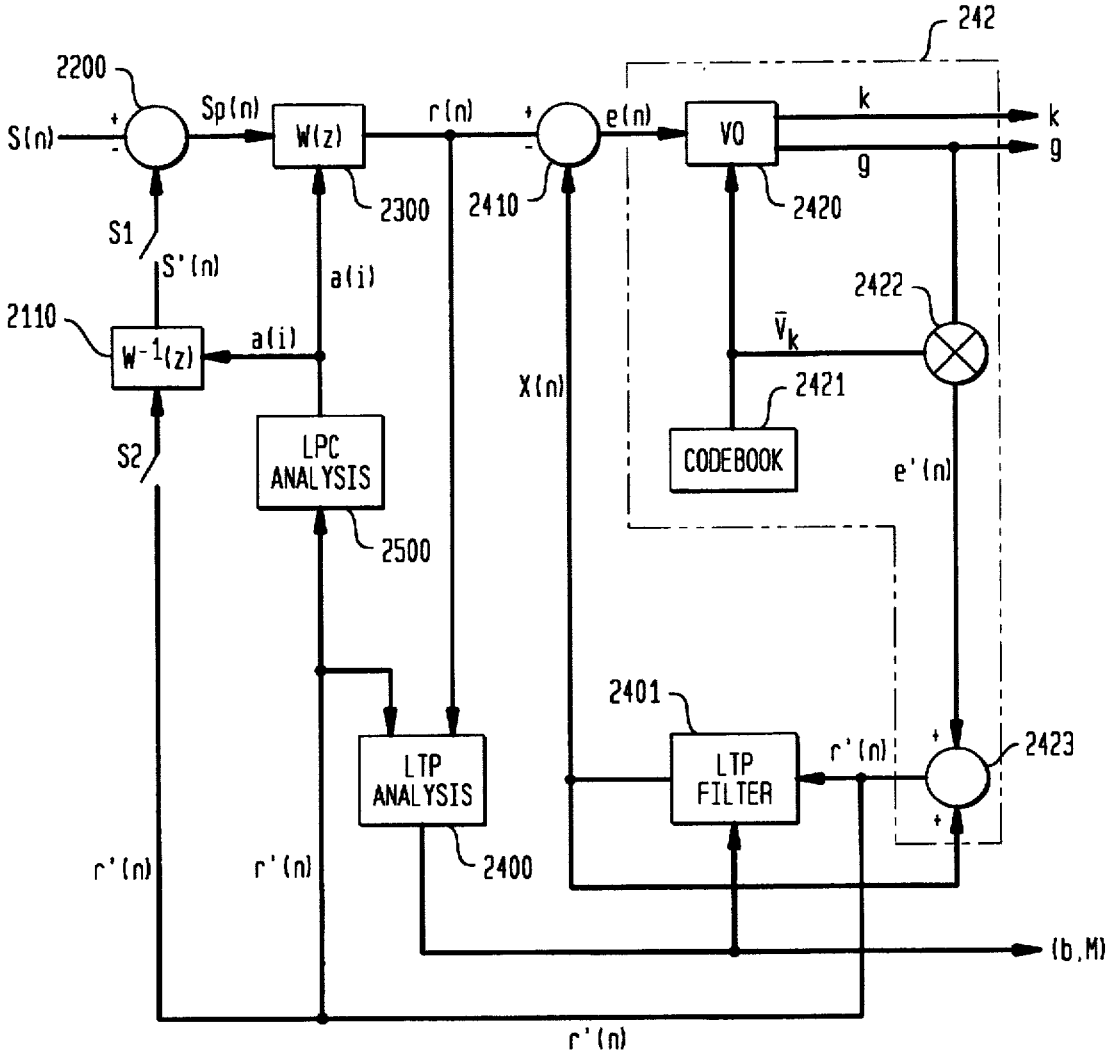
FIG. 2 illustrates a second speech encoder.

(2) The speech coder of FIG. 2 vs present invention:

(a) In FIG. 2, a forward pitch predictor is used, whereas in the present invention, a backward zero-input short-term predictor is used.

(b) In FIG. 2, the minimum delay is greater than 1 ms for a 16 kbps bit rate, whereas in the present invention, the minimum delay can be less than 1 ms for a 16 kbps bit rate.

Finally, the aforementioned embodiment is intended to be merely illustrative. Numerous alternative embodiments may be devised by those ordinarily skilled in the art without departing from the spirit and scope of the following claims.

The claimed invention is:

1. A speech encoder comprising:

a perceptual weighting filter W(z) receiving a speech signal S(n), a reconstructed speech signal S'(n), a reconstructed residual signal r'(n), and a set of tuning coefficients $a_i$, and outputting a residual excitation signal r(n), a coding/decoding circuit receiving an error signal e(n) equal to the difference between said residual excitation signal r(n) and a predictive residual excitation signal X(n), and outputting a reconstructed error signal e'(n), a codebook index signal k, and a gain parameter c, a Linear Predictive Coding (LPC) circuit receiving said reconstructed residual signal r'(n), equal to the sum of said reconstructed error signal e'(n) and said predictive residual excitation signal X(n), and outputting said set of tuning coefficients $a_i$, and a Short Term Predictive (STP) circuit receiving said reconstructed residual signal r'(n) and said set of tuning coefficients $a_i$, and outputting said predictive residual excitation signal X(n).

2. The speech encoder of claim 1 wherein said filter W(z) evaluates the following equation:

$$r(n)=S(n)-\sum_{i=1,n-i\geqq 0}^{10} a_i\alpha^i S(n-i)-\sum_{i=1,n-i<0}^{10} a_i\alpha^i S'(n-i)+$$

$$\sum_{i=1,n-i\geqq 0}^{10} a_i\gamma^i r(n-i)+\sum_{i=1,n-i<0}^{10} a_i\gamma^i r'(n-i)$$

where $\alpha=0.9$, $\gamma=0.6$.

3. The speech encoder of claim 1 wherein said coding/decoding circuit further comprises a shape/gain type Vector Quantizer and a Scalar Quantizer.

4. The speech encoder of claim 1 wherein said LPC circuit performs a backward LPC analysis using a window of length 120, including reconstructed residues of said reconstructed residual signal r'(n), for n=−120 to −1, and wherein said LPC circuit derives an autocorrelation function R(k), where k=0 to 10.

5. The speech encoder of claim 4 wherein said LPC circuit uses Durbin's method to derive said set of tuning coefficients $a_i$, where i=1 to 10.

6. The speech encoder of claim 1 wherein said STP circuit uses a backward zero-input short term prediction technique.

7. The speech encoder of claim 1 wherein said STP circuit evaluates the following equation:

$$X(n)=\sum_{i=1}^{10} a_i X(n-i)$$

where $X(n)=r'(n)$ for $-10 \leqq n \leqq -1$.

8. The speech encoder of claim 1 further comprising an inverse perceptual weighting filter $W^{-1}(z)$ receiving said reconstructed residual signal $r'(n)$ and said set of tuning coefficients $a_i$ and outputting said reconstructed speech signal $S'(n)$.

9. A speech decoder comprising:

a Linear Predictive Coding (LPC) circuit receiving a reconstructed residual signal $r'(n)$, equal to the sum of a reconstructed error residual signal $e'(n)$ and a predictive residual excitation signal $X(n)$, and outputting a set of tuning coefficients $a_i$, a Short Term Predictive (STP) circuit also receiving said reconstructed residual signal $r'(n)$ and said set of tuning coefficients $a_i$, and outputting said predictive residual excitation signal $X(n)$, and an inverse perceptual weighting filter $W^{-1}(z)$ receiving said reconstructed residual signal $r'(n)$ and said set of tuning coefficients $a_i$, and outputting a reconstructed speech signal $S'(n)$.

10. The speech decoder of claim 9 further comprising a decoder circuit receiving a gain parameter c and a codebook index signal k and outputting said reconstructed error residual signal $e'(n)$.

11. A method of speech encoding comprising the steps of:

a) filtering a speech signal $S(n)$, a reconstructed speech signal $S'(n)$, and a reconstructed residual signal $r'(n)$, using a set of tuning coefficients $a_i$ to produce a residual excitation signal $r(n)$, b) coding and decoding an error signal $e(n)$ equal to the difference between said residual excitation signal $r(n)$ and a predictive residual excitation signal $X(n)$, to produce a reconstructed error residual signal $e'(n)$, c) applying linear analysis to said reconstructed residual signal $r'(n)$, equal to the sum of said reconstructed error residual signal $e'(n)$ and said predictive residual excitation signal $X(n)$, and deriving therefrom said set of tuning coefficients $a_i$, and d) generating said predictive residual excitation signal $X(n)$ from said reconstructed residual signal $r'(n)$ and said set of tuning coefficients $a_i$.

12. The method of claim 11 wherein said residual excitation signal $r(n)$ is produced in accordance with the following equation:

$$r(n)=S(n)-\sum_{i=1,n-i\geqq 0}^{10} a_i\alpha^i S(n-i)-\sum_{i=1,n-i<0}^{10} a_i\alpha^i S'(n-i)+\sum_{i=1,n-i\geqq 0}^{10} a_i\gamma^i r(n-i)+\sum_{i=1,n-i<0}^{10} a_i\gamma^i r'(n-i)$$

where $\alpha=0.9$, $\gamma=0.6$.

13. The method of claim 11 wherein said predictive residual excitation signal $X(n)$ is generated in accordance with the following equation:

$$X(n)=\sum_{i=1}^{10} a_i X(n-i)$$

where $X(n)=r'(n)$ for $-10 \leqq n \leqq -1$.

14. The method of claim 11 further comprising the step of generating from said reconstructed residual signal $r'(n)$ and said set of tuning coefficients $a_i$ said reconstructed speech signal $S'(n)$.

15. A method of speech decoding comprising the steps of:

a) generating from a reconstructed residual signal $r'(n)$, which is the sum of a reconstructed error residual signal $e'(n)$ and a predictive residual excitation signal $X(n)$, a set of tuning coefficients $a_i$, b) generating from said reconstructed residual signal $r'(n)$ and said set of tuning coefficients $a_1$, said predictive residual excitation signal $X(n)$, and c) synthesizing a reconstructed speech signal $S'(n)$ from said reconstructed residual signal $r'(n)$ and said set of tuning coefficients $a_i$.

16. The method of claim 15 further comprising the step of generating from a codebook index signal k and a gain parameter c, said reconstructed error residual signal $e'(n)$.

17. A speech processing system comprising:

a speech encoder circuit comprising:

a perceptual weighting filter $W(z)$ receiving a speech signal $S(n)$, a reconstructed speech signal $S'(n)$, a reconstructed residual signal $r'(n)$, and a set of tuning coefficients $a_i$, and outputting a residual excitation signal $r(n)$, a coding/decoding circuit receiving an error signal $e(n)$ equal to the difference between said residual excitation signal $r(n)$ and a predictive residual excitation signal $X(n)$, and outputting a reconstructed error signal $e'(n)$, a codebook index signal k, and a gain parameter c, a Linear Predictive Coding (LPC) circuit receiving said reconstructed residual signal $r'(n)$, equal to the sum of said reconstructed error signal $e'(n)$ and said predictive residual excitation signal $X(n)$, and outputting said set of tuning coefficients $a_i$, a Short Term Predictive (STP) circuit receiving said reconstructed residual signal $r'(n)$ and said set of tuning coefficients $a_i$, and outputting said predictive residual excitation signal $X(n)$, and an first inverse perceptual weighting filter $W^{-1}(z)$ receiving said reconstructed residual signal $r'(n)$ and said set of tuning coefficients $a_i$, and outputting said reconstructed speech signal $S'(n)$, and a speech decoder comprising:

a second decoder circuit receiving said codebook index signal k and said gain parameter c, and outputting a second reconstructed error residual signal $e'(n)$, a second Linear Predictive Coding (LPC) circuit receiving a second reconstructed residual signal $r'(n)$, equal to the sum of said reconstructed error residual signal e'(n) and a second predictive residual excitation signal X(n), and outputting a second set of tuning coefficients $a_i$, a second Short Term Predictive (STP) circuit also receiving said second reconstructed residual signal r'(n) and said second set of tuning coefficients $a_i$, and outputting said second predictive residual excitation signal X(n), and an second inverse perceptual weighting filter $W^{-1}(z)$ receiving said second reconstructed residual signal r'(n) and said second set of tuning coefficients $a_i$, and outputting a second reconstructed speech signal S'(n).

18. The method of claim 11 wherein said step (b) further comprises the steps of:

(b1) coding said difference signal e(n) to produce a codebook index signal k and a gain parameter c, and (b2) decoding said codebook index signal k and gain parameter c to output a reconstructed signal e'(n).

* * * * *